US006617502B2

(12) United States Patent
Suzuki et al.

(10) Patent No.: US 6,617,502 B2
(45) Date of Patent: Sep. 9, 2003

(54) KEYBOARD DEVICE FOR ELECTRONIC KEYBOARD MUSICAL INSTRUMENT

(75) Inventors: Akihiro Suzuki, Shizuoka-ken (JP); Yoshiaki Shimoda, Shizuoka-ken (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/956,048

(22) Filed: Sep. 20, 2001

(65) Prior Publication Data

US 2002/0038595 A1 Apr. 4, 2002

(30) Foreign Application Priority Data

Sep. 29, 2000 (JP) ..... 2000-298814
Oct. 10, 2000 (JP) ..... 2000-309162

(51) Int. Cl.[7] ..... G10C 3/12

(52) U.S. Cl. ..... 84/423; 84/435; 84/434; 84/438

(58) Field of Search ..... 84/423 R, 433, 84/434, 435, 436, 438, 450, 452 R

(56) References Cited

U.S. PATENT DOCUMENTS 5,505,115 A * 4/1996 Vandervoort ..... 84/423 R
5,542,332 A * 8/1996 Tamai et al. ..... 84/435
5,945,617 A * 8/1999 Niitsuma ..... 84/423 R

* cited by examiner

*Primary Examiner*—Kimberly Lockett
(74) *Attorney, Agent, or Firm*—Crowell & Moring LLP

(57) ABSTRACT

A keyboard device for an electronic keyboard musical instrument is provided for permitting a significant reduction in the number of parts constituting a hammer supporting members and the number of assembling steps required therefor, thereby reducing a manufacturing cost, and also for permitting hammers to be mounted in a high mounting accuracy to eliminate noise. The keyboard device comprises a chassis, a hammer rail made of an aluminum extrudate and coupled to the chassis, a plurality of keys pivotably supported by the chassis, a plurality of hammers each provided for each of the plurality of keys, pivotably supported by the hammer rail and configured to pivot in response to depression on a key associated therewith, and a stopper mounted to the hammer rail for restricting a pivotal movement of a hammer caused by depression on a key associated with the hammer.

10 Claims, 8 Drawing Sheets

KEYBOARD DEVICE FOR ELECTRONIC KEYBOARD MUSICAL INSTRUMENT

BACKGROUND OF THE INVENTION

1. Field of the Invention

The present invention relates to a keyboard device for an electronic keyboard musical instrument such as an electronic piano which has keys and hammers each pivotally movable in response to depression on an associated key.

2. Description of the Prior Art

FIGS. 1 through 3 illustrate an exemplary keyboard device of a conventional electronic piano. The illustrated keyboard device 51 comprises a chassis 2; a large number of keys 3 (one each of white key 3*a* and black key 3*b* are illustrated) arranged side by side in the lateral direction (in the depth direction in FIG. 10) on the chassis 2; a large number of hammers 4 (only one of which is illustrated) each pivotally movable in response to depression of an associated key 3. The chassis 2 is made of a steel plate or the like which is punched out and bent through a press work. Each of the keys 3 is pivotably supported at the center thereof by a balance pin 6 implanted on the chassis 2.

The hammer 4 is supported by a hammer rail 52 coupled to a rear end portion of the chassis 2 through a fulcrum member 53. The hammer rail 52 is made of a press-worked steel plate or the like, as is the case with the chassis 2. The hammer rail 52 extends in the lateral direction to cover all the hammers 4, and fixed to the chassis 2 at a plurality of locations with screws 61, and also fixed to a keybed 5 with screws 62. Also, as illustrated in FIG. 3, the hammer rail 52 is formed with a large number of vertical mounting holes 52*a*, 52*b* arranged side by side in the lateral direction for mounting the fulcrum members 53.

A large number of fulcrum members 53 are provided one for each hammer 4. The fulcrum members 53 are made, for example, of synthetic resin moldings by injection molding. As illustrated in FIG. 2, each of the fulcrum members 53 comprises a body 53*a* in the shape of inverted C in cross-section, which has an opened front surface; an upper and a lower engaging protrusion 53*b*, 53*c* (see FIG. 3) formed on the back surface of the body 53*a*; shaft holes 53*d* formed in a left and a right wide wall of the body 53*a* such that they are open to the front face each other; a key switch mount 53*f* formed on the top surface of the body 53*a* and having an engaging recess 53*e*.

Then, as illustrated in FIG. 3, each of the fulcrum members 53 is mounted on the hammer rail 52 by fitting the upper and lower protrusions 53*b*, 53*c* into the upper and lower mounting holes 52*a*, 52*b* of the hammer rail 52, respectively. Also, as illustrated in FIG. 2, engaged protrusions 4*a* (only one of which is illustrated) protruding on both sides of the hammer 4 are fitted into the shaft holes 53*d* of the fulcrum member 53 mounted on the hammer rail 52 in the foregoing manner, thereby pivotably supporting the hammer 4 by the fulcrum member 53. In this structure, both side walls of the fulcrum member 53 define a space for allowing pivotal movements of the hammer 4, and serve to prevent the hammer 4 from shifting in lateral directions. In addition, the hammer 4 is carried on a rear end portion of the associated key 3, so that depression on the key 3 causes the hammer 4 to pivotally move to apply the key 3 with a touch weight similar to that of an acoustic piano.

A plurality of action ribs 54, for example, arranged in octaves, are attached to the hammer rail 52 with a large number of screws 63 (only two of which are illustrated) at predetermined intervals in the lateral direction. Stopper rails 55 are attached to the leading ends of the action ribs 54 with a large number of screws 64 (only two of which are illustrated). The stopper rails 55 extend in the lateral direction to cover all the hammers 4. These action ribs and stopper rails 55 are made of press-worked steel plates or the like, as is the case with the hammer rail 52.

Each of the stopper rails 55 comprises a stopper 14 for restricting the associated hammer 4 from pivotally moving upward; and a key switch 15 for detecting information on depression on the associated key 3. The stopper 14 extends in the lateral direction to cover the whole length of the hammer 4, and is made of foamed urethane or the like. The key switch 15 is mounted to the stopper rail 55 with screws (not illustrated), with its printed board 16 having a rear end portion inserted into the engaging recess 53*e* of the fulcrum member 53.

The conventional keyboard device 51 described above requires a large number of parts because the hammer rail 52, action ribs 54 and stopper rails 55 are individually assembled into the keyboard device 51, and these components must be coupled to one another with a large number of screws 63, 64. Also, the supporting members 53 for supporting a large number of hammers 4 are required in a number equal to the number of hammers 4, resulting in the need for a quite large number of parts. In addition, such a large number of supporting members 53 must be manually mounted to the hammer rail 52 one by one. Consequently, the conventional keyboard device 51 requires a quite large number of parts as well as assembling steps, causing an increased manufacturing cost.

Furthermore, the hammer rail 52, action ribs 54 and stopper rails 55 are all made of press-worked steel plates or the like, making it difficult to achieve a high assembly accuracy, due to a low dimensional accuracy of each component and an additional assembly errors. As a result, the hammers 4, stoppers 14, key switches 15 and so on, attached to these components, are also susceptible to large mounting errors, and therefore require a delay for adjustments, contributing to an increased manufacturing cost as well. Moreover, the supporting member 53 is mounted to the hammer rail 52 by fitting the engaging protrusions 53*b*, 53*c* of the supporting member 53 into the mounting holes 52*a*, 52*b* of the hammer rail 52, while the supporting member 53 is made of a synthetic resin molding. This inevitably causes variations, to some degree, in dimensional accuracy of the engaging protrusions 53*b*, 53*c*, and therefore in a positional relationship and a dimensional relationship between the engaging protrusions 53*b*, 53*c* and the mounting holes 52*a*, 52*b* among the fulcrum members 53, leading as well to a lower mounting accuracy of the hammers 4.

Also, since the stopper 14 is attached to the stopper rail 55 supported over a plurality of action ribs 54 arranged at intervals, the action ribs 54 are susceptible to vibrations due to collision of the hammer 4 with the stopper 14, possibly causing noise.

SUMMARY OF THE INVENTION

The present invention has been made to solve the problems as mentioned above, and it is an object to provide a keyboard device for an electronic keyboard musical instrument which permits a significant reduction in the number of parts constituting hammer supporting members and the number of assembling steps required therefor, thereby reducing a manufacturing cost, and also permits hammers to be mounted in a high mounting accuracy to eliminate noise.

To achieve the above object, a keyboard device for an electronic keyboard musical instrument according to a first aspect of the present invention includes a chassis; a hammer rail made of an aluminum extrudate, and coupled to the chassis; a plurality of keys pivotably supported by the chassis; a plurality of hammers each provided for each of the plurality of keys, wherein each hammer is pivotably supported by the hammer rail and configured to pivot in response to depression on a key associated therewith; and a stopper mounted to the hammer rail for restricting a pivotal movement of a hammer caused by depression on a key associated with the hammer.

According to this keyboard device for an electronic keyboard musical instrument, the hammers are supported by the hammer rail made of an aluminum extrudate, to which the stopper is mounted for restricting pivotal movements of the hammers. In other words, the hammer rail of the keyboard device has in combination a function of the hammer rail for supporting the hammers; a function of stopper rails for mounting the stopper; and a function of action ribs for coupling both rails, among functions provided by the aforementioned conventional keyboard device. In this way, since the conventional hammer rail, plurality of action ribs, and stopper rails are replaced with the single hammer rail, the number of parts can be reduced correspondingly. In addition, the number of assembling steps can be largely reduced by virtue of complete elimination of numerous screwing works for assembling the components, as required in the conventional keyboard device.

Since the hammer rail is comprised of an aluminum extrudate, the dimensional accuracy of the hammer rail is higher than the conventional counterpart made of a press-worked steel plate or the like, without any assembling errors added to the resulting keyboard device. As a result, since the hammers and stopper are mounted on the hammer rail in a higher mounting accuracy, adjustments therefor are eliminated or facilitated. Further, unlike the conventional keyboard device in which the stoppers are mounted on the stopper rail supported by a plurality of action ribs arranged at intervals, the keyboard device of the present invention can limit vibrations due to collision of the hammer with the stopper and prevent noise caused by the vibrations.

In the foregoing keyboard device, the hammer rail preferably includes a single hammer rail extending in a direction in which the plurality of hammers are arranged side by side for supporting all the hammers.

In this structure, since the single hammer rail alone is provided for the whole keyboard device, the number of parts can be further reduced. In addition, the number of assembling steps can be largely reduced by virtue of complete elimination of numerous screwing works for assembling the components of the hammer rail, and the mounting accuracy can be further increased for the hammers and so on.

Preferably, the hammer rail includes a fulcrum shaft integrally formed therewith, wherein the fulcrum shaft extends in a lengthwise direction of the hammer rail in engagement with the plurality of hammers for supporting the same.

In this structure, since the fulcrum shaft in engagement with the hammers for supporting is also molded integrally with the hammer rail, the number of parts and the number of assembling steps can be largely reduced as compared with the conventional keyboard device in which a fulcrum member is provided for each hammer, and the mounting accuracy can be further increased for the hammer.

Preferably, the keyboard device for an electronic keyboard musical instrument further includes key switches each for detecting information on depression on an associated keys, and a key switch mount integrally molded with the hammer rail, extending in a lengthwise direction of the hammer rail for mounting the key switch thereon.

In this structure, since the key switch mount for mounting the key switches thereon for detecting information on depression on the plurality of keys is also integrally molded with the hammer rail, the mounting accuracy can be increased for the key switch.

In this event, the hammer rail preferably has a hollow cross-section.

The provision of the hollow hammer rail permits a reduction in weight and material cost as well as a sufficient rigidity ensured to support an impact due to collision of the hammer with the stopper.

To achieve the above object, a keyboard device for an electronic keyboard musical instrument according to a second aspect of the present invention includes a chassis; a hammer rail coupled to the chassis; a plurality of keys arranged side by side in a lateral direction and pivotally supported by the chassis; a plurality of hammers arranged side by side in the lateral direction, each of which is provided for each of the keys, and configured to pivot in response to depression on the key associated therewith; and a fulcrum shaft made of an aluminum extrudate integrally with the hammer rail to extend in the lateral direction in engagement with the plurality of the hammers for pivotably supporting the hammers.

According to this keyboard device for an electronic keyboard musical instrument, since a plurality of hammers are supported by the single fulcrum shaft made of an aluminum extrudate, the number of parts and the number of assembling steps can be reduced as compared with the conventional keyboard device in which a supporting member is provided for each hammer. For the same reason, variations in the fulcrum positions among the hammers are reduced as compared with the conventional keyboard device in which fulcrum members are molded and mounted on the hammer rail on a one-by-one basis, thereby making it possible to mount the hammers in a higher mounting accuracy.

In the foregoing keyboard device, the fulcrum shaft preferably includes a single fulcrum shaft for supporting all the hammers.

In this structure, since the single fulcrum shaft is provided for the whole keyboard device, it is possible to largely reduce the number of parts and the number of assembling steps as well as further increase the mounting accuracy for the hammer.

Preferably, the hammer rail is molded integrally with the fulcrum shaft.

In this structure, since the hammer rail for supporting the hammers through the fulcrum shaft is integrally molded with the fulcrum shaft as an aluminum extrudate, the number of parts and the number of assembling steps can be further reduced as compared with the conventional keyboard device in which such components are individually formed and assembled into a hammer rail. For the same reason, saccadic movements of the fulcrum shaft itself are eliminated to prevent noise, generated when a key is depressed, caused by such saccadic movements.

Preferably, the keyboard device for an electronic keyboard musical instrument further includes a fulcrum member formed of a synthetic resin molding and mounted to the fulcrum shaft to surround the fulcrum shaft, wherein the plurality of hammers are engaged with and supported by the fulcrum member.

Generally, a molding made of synthetic resin, constituting the fulcrum member, exhibits a higher molding accuracy than the aluminum extrudate constituting the fulcrum shaft. Therefore, according to the foregoing structure, the mounting accuracy can be further increased for the hammers by supporting a plurality of hammers by the single fulcrum member mounted on the fulcrum shaft, as compared with hammers directly supported by a fulcrum shaft. Also, the high molding accuracy of the fulcrum member limits saccadic movements of the hammers. The synthetic resin having a higher lubricity than aluminum can help ensure smooth pivotal movements of the hammers, thereby preventing noise generated from the supporter of the hammers.

In the foregoing structure, preferably, the keyboard device for an electronic keyboard musical instrument further includes a plurality of lateral shift stoppers each provided every predetermined number of the hammers near the fulcrum shaft for restricting lateral movements of the hammers.

In this structure, since the plurality of lateral shift stoppers restrict lateral movements of the hammers, the hammers can be prevented from shifting in the lateral direction. In other words, the lateral shift stoppers can solve the problem of lateral shift experienced by the hammers caused by the extension of the fulcrum shaft in the lateral direction for supporting a plurality of hammers.

DETAILED DESCRIPTION OF THE PREFERRED EMBODIMENTS

Figure 1:
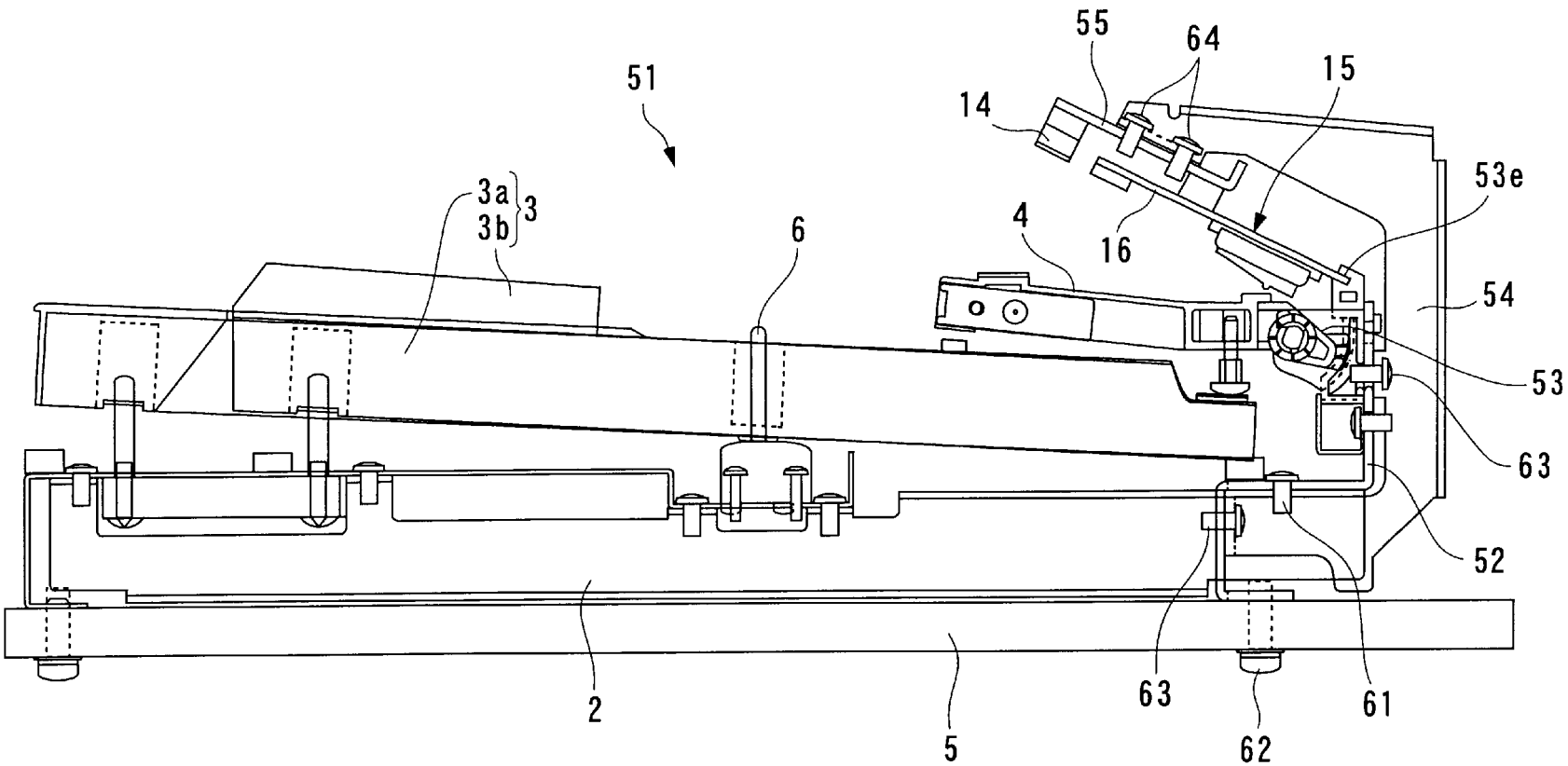
FIG. 1 is a lateral view of a conventional keyboard device for an electronic piano.
Figure 2:
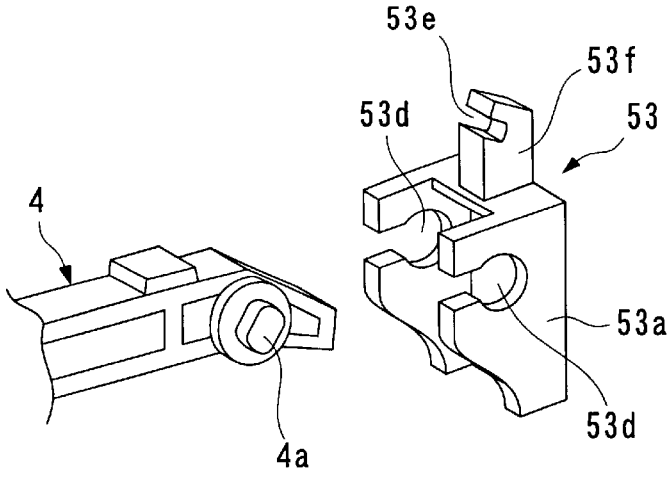
FIG. 2 is a diagram showing how a hammer is mounted to a fulcrum member in the conventional keyboard device.
Figure 3:
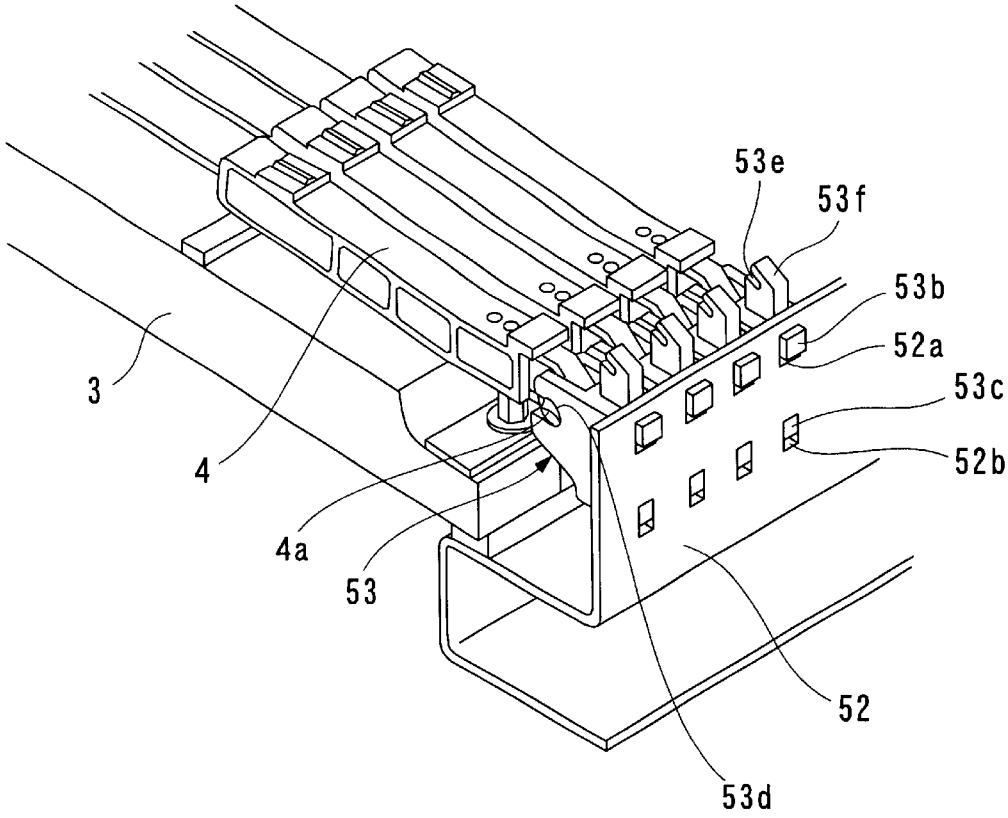
FIG. 3 is a partial perspective view of the conventional keyboard device for an electronic piano.
Figure 4:
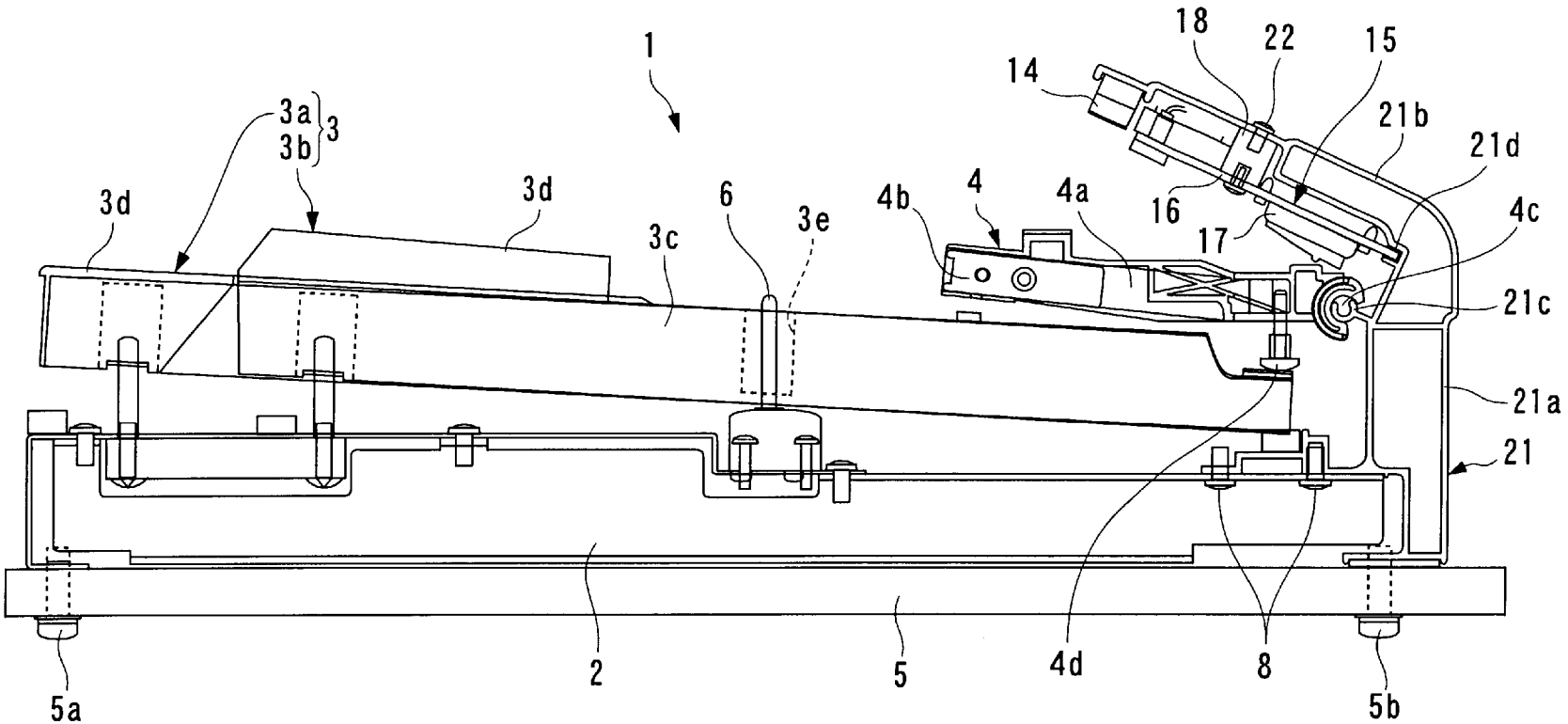
FIG. 4 is a lateral view of a keyboard device for an electronic piano according to a first embodiment of the present invention.

In the following, preferred embodiments of the present invention will be described in detail with reference to the accompanying drawings. FIGS. 4 and 5 illustrate a keyboard device for an electronic piano according to a first embodiment of the present invention. It should be noted that in the following description, components of the keyboard device 1 having identical or similar functions to those of the conventional keyboard device 51 previously described above are designated the same reference numerals.

Like the keyboard device 51, the keyboard device 1 comprises a chassis 2, a large number of keys 3 (only one each of white key 3*a* and black key 3*b* are illustrated) arranged side by side on the chassis 2 in the lateral direction; and a large number of hammers 4 (only one of which is illustrated) each pivotally movable in response to depression on an associated key 3.

The chassis 2 is made of steel plates punched out and bent through press work, which are assembled into parallel crosses, and is horizontally fixed on the keybed 5 with screws 5*a*. A large number of balance pins 6 (only one of which is illustrated) are implanted in a central portion of the chassis 2 in the front-to-rear direction, arranged side by side in the lateral direction. Each of the keys 3 is pivotably supported at the center thereof by an associated balance pin 6.

A keyboard 3 consists of white keys 3*a* and black keys 3*b*, each of which is comprised of a key body 3*c* made of wood and having a rectangular cross-section; and a key cover 3*d* made of synthetic resin and adhered to a front portion of the top surface thereof. The key body 3*c* is formed with a balance pin hole 3*e* at the center thereof, such that the key 3 is pivotably supported by the balance pin 6 through the balance pin hole 3*e*.

Each of the hammers 4, associated with one key 3, comprises a rod-shaped hammer body 4*a* made of a synthetic resin and having a rectangular cross-section; and weight plates 4*b* (only one of which is illustrated) mounted to front portions of both sides of the hammer body 4*a*, as illustrated in FIG. 5. The hammer body 4*a* is formed with an arcuate shaft hole 4*c*, which is open to the rear, in a rear end portion thereof. The hammer 4 is pivotably supported by a hammer rail 21 with the shaft hole 4*c* engaged with a fulcrum shaft 21*c* of the hammer rail 21, later described. An adjustment screw 4*d* is movably attached on the lower surface of the hammer body 4*a* at a position near the shaft hole 4*c*. The hammer 4 is carried on a rear end portion of the top surface of an associated key 3 through the adjustment screw 4*d*.

The hammer rail 21, which is comprised of a single hollow extrudate made of aluminum, extends in the lateral direction to cover all the hammers 4. The hammer rail 21 is coupled to the chassis 2 with screws 8, and also fixed to a keybed 5 with screws 5*b*. The provision of the hollow hammer rail 21 permits a reduction in weight and material cost as well as a sufficient rigidity ensured to support an impact due to collision of the hammer 4 with the stopper 14, later described. The hammer rail 21 has integrated therewith, a hammer supporter 21*a* extending in the vertical direction; a stopper mount 21*b* extending diagonally upward in front from the upper end of the hammer supporter 21*a*; the aforementioned fulcrum shaft 21*c* protruding in front from the top of the hammer supporter 21*a*; and so on.

Figure 5A:
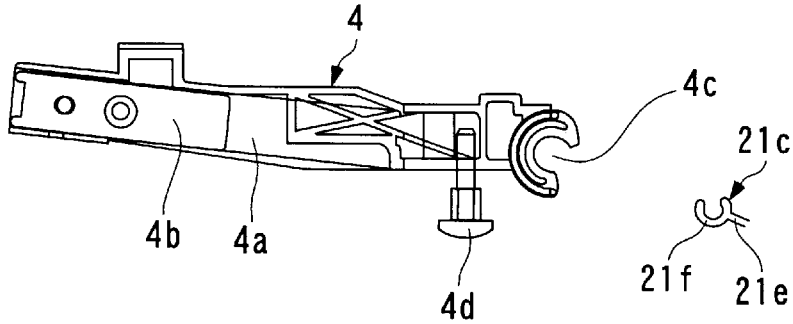
FIGS. 5A–5C are diagrams illustrating how a hammer is mounted to a fulcrum shaft in the first embodiment.
Figure 5B:
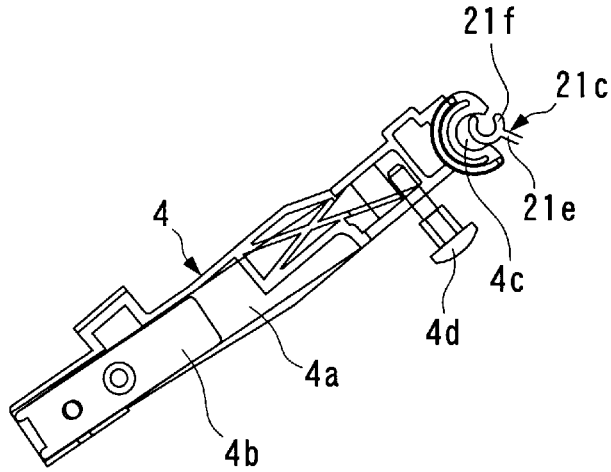
Figure 5C:
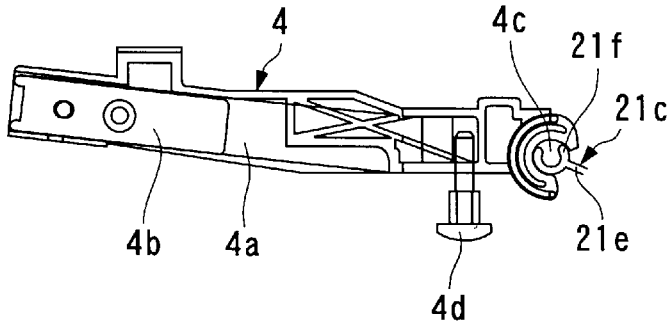

As illustrated in FIGS. 5A–5C, the fulcrum shaft 21*c* is comprised of a base 21*e* extending diagonally upward in front from the hammer supporter 21*a*; and an arcuate engaging portion 21*f* formed at the leading end of the base 21*c* and having an upper portion cut away. The hammer 4 is pivotably supported and prevented from coming off by the fulcrum shaft 21*c* by fitting the engaging portion 21*f* into the shaft hole 4*c*, with the rear side of the hammer 4 inclined upward (FIG. 5B), and pivoting the hammer 4 about the engaging portion 21*f* to a horizontal posture (FIG. 5C).

The stopper mount 21*b* is provided with a stopper 14 at the leading end thereof for restricting an upward pivotal movement of the hammer 4. The stopper 14 also extends in the lateral direction to cover the whole length of the hammer 4, and is made of foamed urethane or the like. A key switch 15 is further disposed above the hammer 4 for detecting information on depression on the associated key 3. The key switch 15 is comprised of a printed board 16; and a switch body 17 made of rubber attached on the printed board 16 for each key 3. The key switch 15 is mounted to the stopper mount 21*b* with screws 22 through a spacer 18, with a rear end portion of the printed board 16 inserted into an engaging recess 21*d* (key switch mount) formed at a proximal end of the stopper mount 21*b*.

According to the keyboard device 1 in the foregoing structure, as the key 3 is depressed, the hammer 4 is lifted up by the rear end of the key 3 to pivot upward about the fulcrum shaft 21*c* into contact with the stopper 14, thereby restricting the upward pivotal movement of the hammer 4 and applying touch feeling similar to that of an acoustic piano. The pivotal movement of the hammer 4 depresses the switch body 17 of the key switch 15, so that the depression on the key 3 and a key depression speed are detected as key depression information.

As described above, according to the keyboard device 1 of the first embodiment, the hammer rail 21 comprised of an aluminum extrudate has in combination the function of the hammer rail 52 for supporting the hammers 4; the function of the stopper rails 55 for mounting the stoppers 14; and the function of the action ribs 54 for coupling both rails 52, 55, among functions of the conventional keyboard device 51. In this way, since the conventional hammer rails 52, plurality of action ribs 54, and stopper rails 55 are replaced with the single hammer rail 21 for the entire keyboard device 1, the number of parts can be reduced correspondingly. In addition, the number of assembling steps can be largely reduced by virtue of complete elimination of numerous screwing works for assembling the components, as required in the conventional keyboard device. Further, since the fulcrum shaft 21*c* for directly supporting the hammers 4 is integrally molded with the hammer rail 21, the number of parts and the number of assembling steps can be largely reduced as compared with the conventional keyboard device in which the supporting member 53 is provided for each hammer 4.

Since the hammer rail 21 is comprised of an aluminum extrudate, the dimensional accuracy of the hammer rail 21 is higher than the conventional counterpart made of a press-worked steel plate or the like, without any assembling errors added to the resulting keyboard device. The fulcrum shaft 21*c* for supporting the hammer 4, and the engaging recess 21*d* for mounting the key switch 15 are also formed integrally with the hammer rail 21. A significant improvement, resulting from the foregoing, in the mounting accuracy of the hammers 4, stoppers 14 and key switches 15 mounted on the hammer rail 21 enables elimination or facilitation of adjustments which would otherwise required for these components.

Further, unlike the conventional keyboard device in which the stoppers 14 are mounted on the stopper rails 55 supported by a plurality of action ribs 54 arranged at intervals, the keyboard device 1 of the first embodiment can limit vibrations due to collision of the hammer 4 to the stopper 14 and prevent noise caused by the vibrations.

Figure 6:
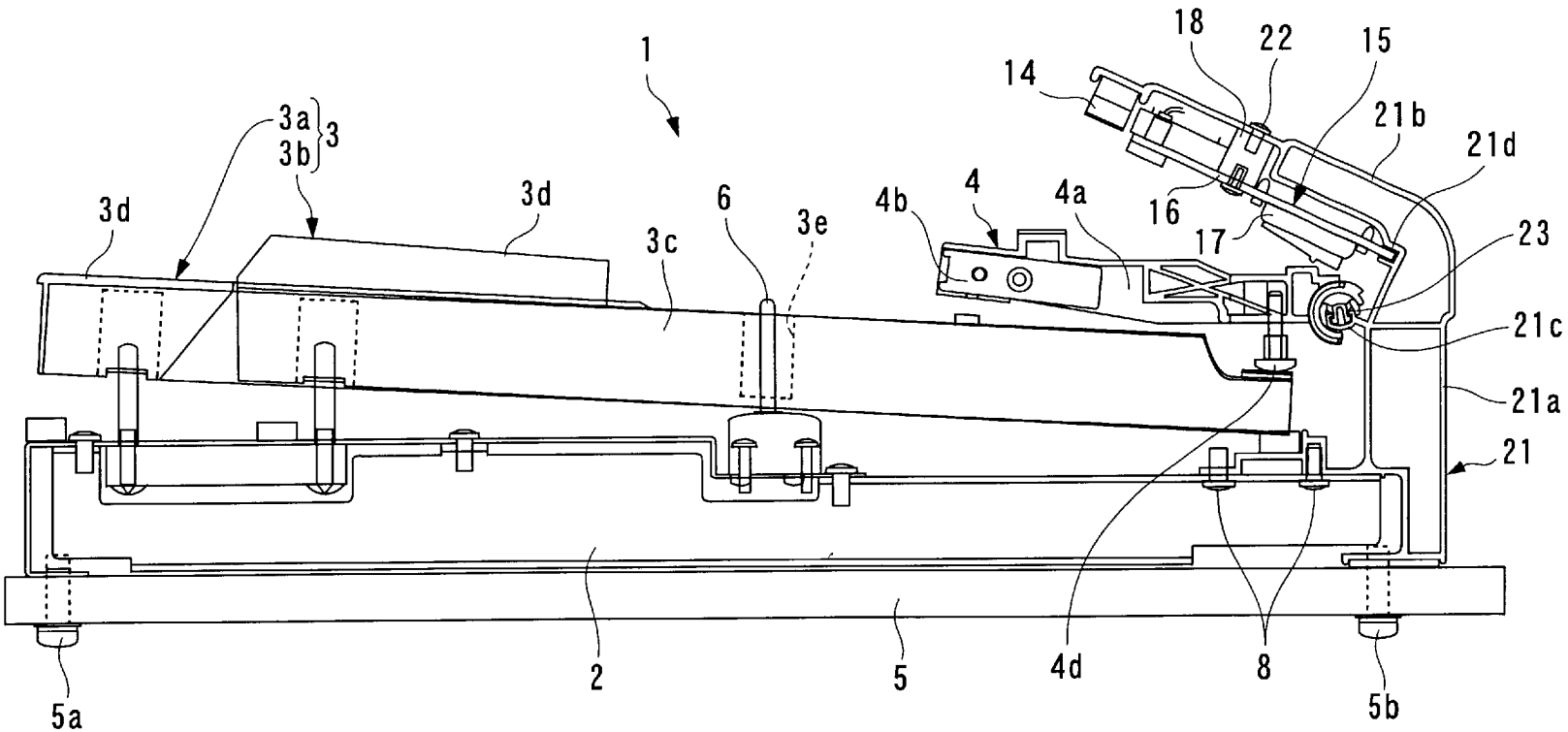
FIG. 6 is a lateral view of a keyboard device for an electronic piano according to a second embodiment of the present invention.
Figure 7:
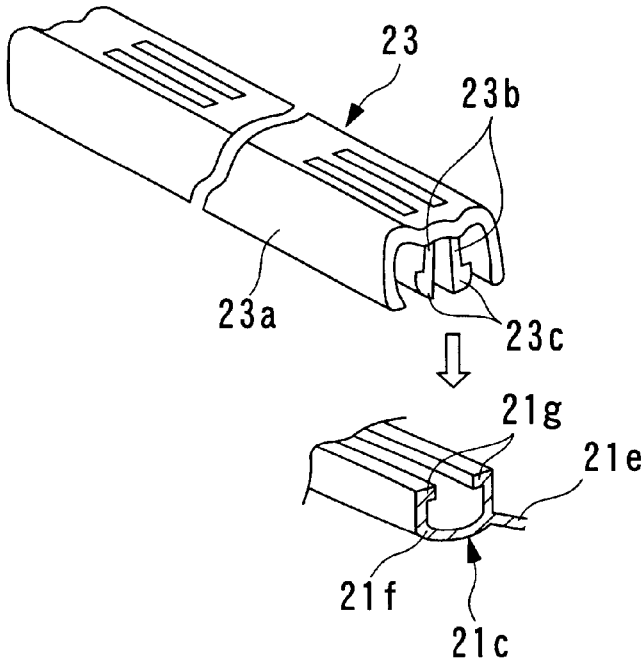
FIG. 7 is a diagram illustrating how a fulcrum shaft is mounted to a fulcrum member in the second embodiment.
Figure 8:
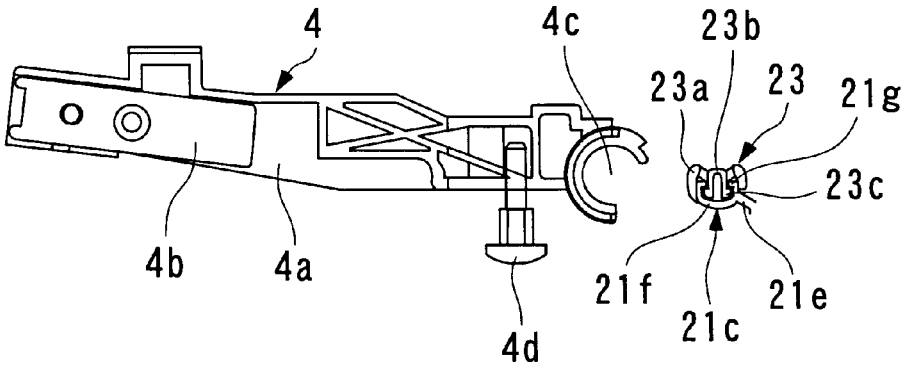
FIG. 8 is a diagram illustrating how a hammer is mounted to the fulcrum member in the second embodiment of the present invention.

FIGS. 6 through 8 illustrate a keyboard device for an electronic piano according to a second embodiment of the present invention. The illustrated keyboard device 1 differs from the first embodiment only in that a fulcrum member 23 (also called the "supporting member") made of a synthetic resin is attached to a fulcrum shaft 21*c* for supporting a hammer 4 on the fulcrum member 23. The rest of the structure is completely the same. As illustrated in FIG. 7, an engaging portion 21*f* of the fulcrum shaft 21*c* in the second embodiment has a U-shaped cross-section, different from the engaging portion 21*f* of the first embodiment having an arcuate cross-section, and is formed at the top ends of both side walls with inwardly protruding shoulders 21*g* which oppose each other.

The supporting member 23 in turn is formed of a single molding made by injection molding a synthetic resin such as polyacetal, for example, having a length covering the whole hammer 4, similarly to the fulcrum shaft 21*c*. The supporting member 23 comprises an inverted U-shaped body 23*a* which is larger than the engaging portion 21*f* of the fulcrum shaft 21*c;* and a pair of tabs 23*b* extending downward from an upper wall of the body 23*a*. Each of the tabs 23*b* is formed with a hook 23*c* extending outward from a lower end thereof. Then, as illustrated in FIG. 7, the supporting member 23 is snap fitted on the fulcrum shaft 21*c* by inserting the tubs 23*b* into the engaging portion 21*f* of the fulcrum shaft 21*c* from above. In this way, as illustrated in FIG. 8, the hook 23*c* of each tab 23*b* is in engagement with the corresponding shoulder 21*g* of the engaging portion 21*f,* thereby mounting the supporting member 23 to the fulcrum shaft 21*c* such that the supporting member 23 is prevented from coming off. The body 23*a* of the fulcrum member 23 surrounds substantially an upper half of the engaging portion 21*f,* with the outer peripheral surface of the body 23*a* forming an arcuate surface having a predetermined curvature.

Further, as illustrated in FIG. 8, a shaft hole 4*c* of the hammer 4 is formed larger than that of the first embodiment to conform to the curvature of the body 23*a* of the fulcrum member 23. The shaft hole 4*c* of each hammer 4 is fitted on the body 23*a* of the fulcrum member 23, thereby rotatably supporting all the hammers 4 by the fulcrum member 23.

Thus, the keyboard device 1 of the second embodiment can produce the effects of the first embodiment completely in the same manner, i.e., a large reduction in the number of parts and the number of assembling steps, as compared with the conventional keyboard device, resulting from all the hammers 4 supported by the single fulcrum shaft 21*c* and supporting member 23, and a higher mounting accuracy in which the hammers 4 and so on can be mounted. In addition, since the molding made of synthetic resin, constituting the fulcrum member 23, exhibits a higher molding accuracy than the aluminum extrudate constituting the fulcrum shaft 21*c,* the mounting accuracy can be further increased for the hammers 4. The high molding accuracy of the fulcrum member 23 limits saccadic movements of the hammers 4. Also, the synthetic resin having a higher lubricity than aluminum helps ensure smooth pivotal movements of the hammers 4, thereby preventing noise generated from the supporter of the hammers 4.

Figure 9:
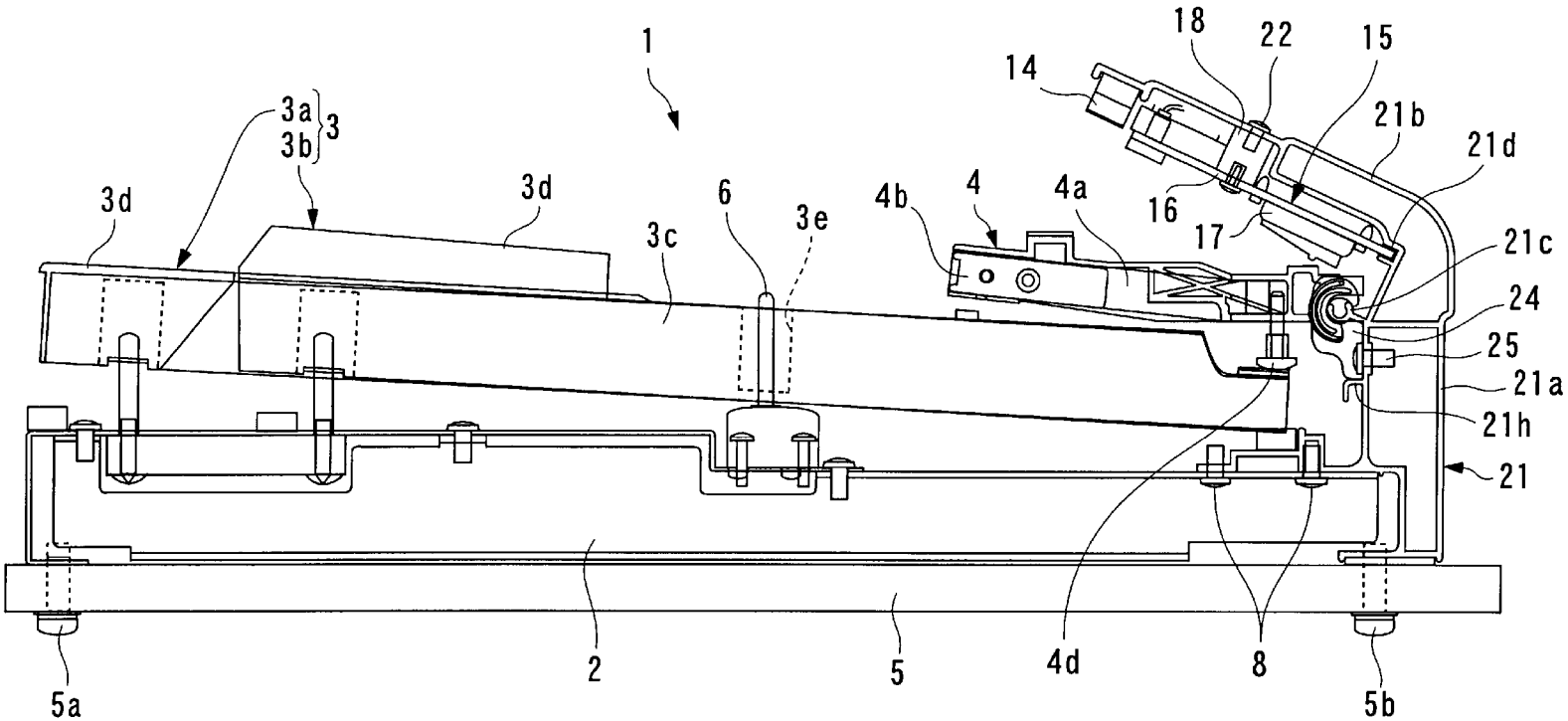
FIG. 9 is a lateral view of a keyboard device for an electronic piano according to a third embodiment of the present invention.
Figure 10:
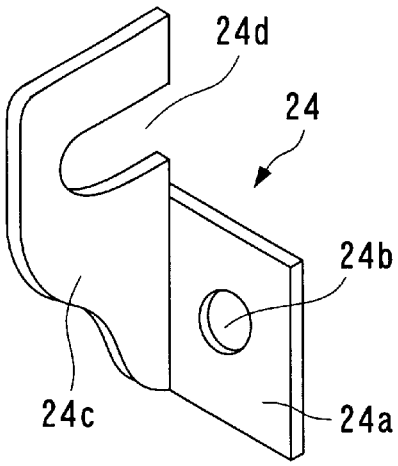
FIG. 10 is a perspective view illustrating a lateral shift stopper in the third embodiment.
Figure 11:
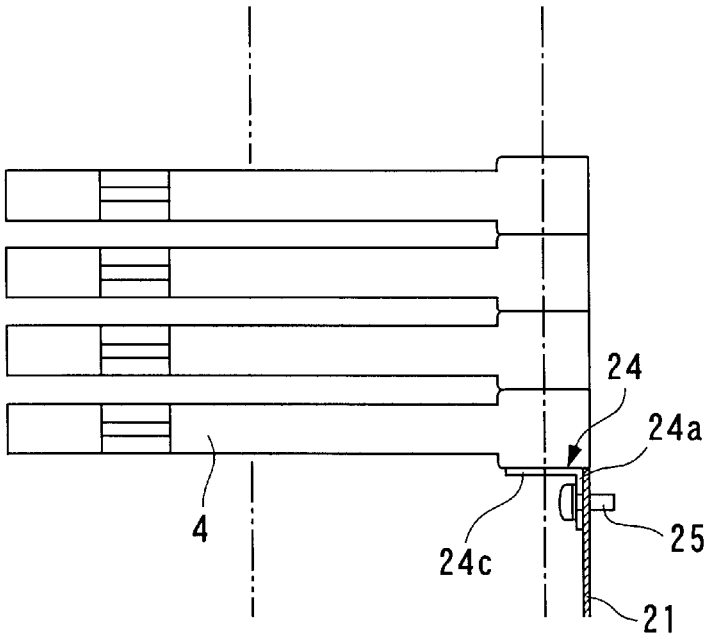
FIG. 11 is a partially omitted plan view illustrating how the lateral shift stopper is mounted in the third embodiment.

FIGS. 9 through 11 illustrate a keyboard device for an electronic piano according to a third embodiment of the present invention. The illustrated keyboard device 1 differs from the aforementioned keyboard device 1 of the first embodiment in that a plurality of lateral shift stoppers 24 are added for preventing lateral shift (shift in the left and right directions) of the hammers 4. Each of the lateral shift stoppers 24 is formed, for example, by pressing a steel plate or the like. As illustrated in FIG. 10, the lateral shift stopper 24 comprises a rectangular mount 24*a* having a mounting hole 24*b;* and a stopper portion 24*c* extending perpendicularly upward from one end of the mount 24*a*. An engaging recess 24*d*, open to the mount 24*a*, is formed in a part of the stopper portion 24*c* above the mount 24*a*. One lateral stopper 24 is provided every predetermined number of hammers 4, for example, in octaves. Specifically, the lateral shift stopper 24 is fixed to a lower position of a fulcrum shaft 21*c* of a hammer rail 21 with screws 25 inserted through the mounting holes 24*b*, with the mount 24*a* carried on a base 21*h* (see FIG. 9) formed on the hammer rail 21 and with an engaging portion 21*f* of the fulcrum shaft 21*c* fitted into the engaging recess 24*d*.

In the foregoing structure, as illustrated in FIG. 11, the stopper portion 24*c* of the lateral shift stopper 24 opposes in close proximity to the outermost one of the hammers 4 for one octave arranged side by side, and restricts lateral movements of the outermost hammer 4, thereby preventing the lateral shift of the hammers 4. In other words, according to the third embodiment, the lateral shift stopper 24 can solve the problem of lateral shift experienced by the hammers 4 caused by the extension of the fulcrum shaft 21*c* in the lateral direction for supporting a plurality of hammers 4.

It should be understood that the present invention is not limited to the embodiments described above but may be practiced in a variety of different manners. For example, while in the foregoing embodiments, the single hammer rail 21 including the fulcrum shaft 21*c* is provided for the while keyboard device 1, the hammer rail 21 may be divided into a plurality of segments in the lateral direction. The same is applied to the supporting member 23 in the second embodiment. Also, while the foregoing embodiments have shown the fulcrum shaft 21*c* molded integrally with the hammer rail 21, the two components may be separately formed and assembled using screws or the like.

As described above, the keyboard device for an electronic keyboard musical instrument according to the present invention permits a significant reduction in the number of parts and the number of assembling steps for the supporting member of the hammers and a resulting reduction in the manufacturing cost, as well as the hammers mounted with a high mounting accuracy without causing noise.

It should be noted that the materials of the respective components shown in the foregoing embodiments are merely illustrative in all aspects and any other appropriate materials may be used instead. Also, while the foregoing embodiments have shown an example in which the present invention is applied to an electronic piano, the present invention is not limited to this particular musical instrument but may be applied to other types of electronic keyboard musical instruments having hammers. Otherwise, the present invention may be modified in structural details as appropriate without departing from the scope and spirit of the present invention defined by the appended claims.

What is claimed is:

1. A keyboard device for an electronic keyboard musical instrument comprising:

a chassis;

a hammer rail made of an aluminum extrudate, and coupled to said chassis;

a plurality of keys pivotably supported by said chassis;

a plurality of hammers each provided for each of said plurality of keys, each said hammer being pivotably supported by said hammer rail and configured to pivot in response to depression on a key associated therewith; and a stopper mounted to said hammer rail for restricting a pivotal movement of a hammer caused by depression on a key associated with said hammer.

2. A keyboard device for an electronic keyboard musical instrument according to claim 1, wherein said hammer rail comprises a single hammer rail extending in a direction in which said plurality of hammers are arranged side by side for supporting all said hammers.

3. A keyboard device for an electronic keyboard musical instrument according to claim 1, wherein said hammer rail comprises a fulcrum shaft integrally formed therewith, said fulcrum shaft extending in a lengthwise direction of said hammer rail in engagement with said plurality of hammers for supporting the same.

4. A keyboard device for an electronic keyboard musical instrument according to claim 1, further comprising:

key switches each for detecting information on depression on said plurality of keys; and a key switch mount integrally molded with said hammer rail, extending in a lengthwise direction of said hammer rail for mounting said key switches thereon.

5. A keyboard device for an electronic keyboard musical instrument according to claim 1, wherein said hammer rail has a hollow cross-section.

6. A keyboard device for an electronic keyboard musical instrument comprising:

a chassis;

a hammer rail coupled to said chassis;

a plurality of keys arranged side by side in a lateral direction and pivotally supported by said chassis;

a plurality of hammers arranged side by side in the lateral direction, each provided for each of said keys, each said hammer configured to pivot in response to depression on said key associated therewith; and a fulcrum shaft made of an aluminum extrudate integrally with said hammer rail, said fulcrum shaft extending in the lateral direction in engagement with said plurality of said hammers for pivotably supporting said hammers.

7. A keyboard device for an electronic keyboard musical instrument according to claim 6, wherein said fulcrum shaft comprises a single fulcrum shaft for supporting all said hammers.

8. A keyboard device for an electronic keyboard musical instrument according to claim 6, wherein said hammer rail is integrally molded with said fulcrum shaft.

9. A keyboard device for an electronic keyboard musical instrument according to claim 6, further comprising:

a fulcrum member formed of a synthetic resin molding and mounted to said fulcrum shaft to surround said fulcrum shaft, said plurality of hammers engaged with and supported by said fulcrum member.

10. A keyboard device for an electronic keyboard musical instrument according to claim 6 further comprising:

a plurality of lateral shift stoppers each provided every predetermined number of said hammers near said fulcrum shaft for restricting lateral movements of said hammers.

* * * * *